US010422262B2

(12) United States Patent
Kim

(10) Patent No.: US 10,422,262 B2
(45) Date of Patent: Sep. 24, 2019

(54) METHOD FOR CATALYST HEATING CONTROL

(71) Applicant: Hyundai Motor Company, Seoul (KR)

(72) Inventor: Seung Bum Kim, Seongnam-si (KR)

(73) Assignee: Hyundai Motor Company, Seoul (KR)

( * ) Notice: Subject to any disclaimer, the term of this patent is extended or adjusted under 35 U.S.C. 154(b) by 92 days.

(21) Appl. No.: 15/367,253

(22) Filed: Dec. 2, 2016

(65) Prior Publication Data

US 2018/0030872 A1 Feb. 1, 2018

(30) Foreign Application Priority Data

Aug. 1, 2016 (KR) ..... 10-2016-0097852

(51) Int. Cl.
*F01N 3/18* (2006.01)
*F01N 9/00* (2006.01)

(52) U.S. Cl.
CPC ..... *F01N 3/18* (2013.01); *F01N 9/005* (2013.01); *F01N 2560/025* (2013.01); *F01N 2560/06* (2013.01); *F01N 2900/0416* (2013.01); *F01N 2900/1404* (2013.01); *F01N 2900/1602* (2013.01); *F01N 2900/1624* (2013.01)

(58) Field of Classification Search
USPC ..... 60/274, 276, 277, 284, 286, 295, 297, 60/303
See application file for complete search history.

(56) References Cited

U.S. PATENT DOCUMENTS 5,129,258 A 7/1992 Homeyer
5,675,967 A * 10/1997 Ries-Mueller ..... F01N 9/005 60/274
5,678,402 A * 10/1997 Kitagawa ..... F01N 9/005 60/276
5,896,743 A * 4/1999 Griffin ..... F01N 11/002 60/274
6,543,220 B2 * 4/2003 Yoshida ..... F02D 41/042 60/274
7,198,952 B2 * 4/2007 Uchida ..... B01D 53/9495 422/108
7,568,337 B2 * 8/2009 Uchida ..... F01N 3/0842 422/83

(Continued)

FOREIGN PATENT DOCUMENTS

JP 05-187226 A 7/1993
JP 2009-299659 A 2/2009

(Continued)

*Primary Examiner* — Binh Q Tran
(74) *Attorney, Agent, or Firm* — Morgan, Lewis & Bockius LLP

(57) ABSTRACT

A method for catalyst heating control for controlling a catalyst heating period of a catalyst heating system in which lambda sensors are each mounted at upstream and downstream sides of a catalyst converter may include determining a temperature of exhaust gas after an engine starts; determining an oxygen storage capacity of a catalyst depending on the determined temperature of the exhaust gas; comparing the determined oxygen storage capacity with a reference value to decide an aging level of the catalyst; and determining times of the catalyst heating period to be different from each other depending on the decided aging level of the catalyst.

9 Claims, 3 Drawing Sheets

(56) References Cited

U.S. PATENT DOCUMENTS

| | | | | |
|---|---|---|---|---|
| 8,656,701 | B2 * | 2/2014 | Akihisa | F01N 11/005 60/277 |
| 2004/0000135 | A1 * | 1/2004 | Uchida | F01N 3/101 60/277 |
| 2012/0023913 | A1 * | 2/2012 | Yoshioka | F01N 11/002 60/285 |
| 2013/0199161 | A1 * | 8/2013 | Aisaka | F01N 3/0864 60/276 |

FOREIGN PATENT DOCUMENTS

| | | | |
|---|---|---|---|
| KR | 10-1998-085349 | A | 12/1998 |
| KR | 10-0373258 | B1 | 12/1998 |
| KR | 10-2004-0022411 | A | 3/2004 |

* cited by examiner

METHOD FOR CATALYST HEATING CONTROL

CROSS-REFERENCE TO RELATED APPLICATION

The present application claims priority to Korean Patent Application No. 10-2016-0097852, filed on Aug. 1, 2016, the entire contents of which is incorporated herein for all purposes by this reference.

BACKGROUND OF THE INVENTION

Field of the Invention

The present invention relates to a method for catalyst heating control, and more particularly, to a method for catalyst heating control configured for improving fuel efficiency by deciding an aging level of a catalyst through a temperature of exhaust gas determined using a lambda sensor and determining an appropriate time of a catalyst heating period depending on the aging level of the catalyst.

Description of Related art

A temperature of exhaust gas exhausted from an engine is a very important factor in developing performance of the engine, a catalyst, or the like.

In the case in which the temperature of the exhaust gas is excessively high, damage to hardware of the engine, damage to the catalyst, and the like, may be caused. Particularly, in an engine in which a turbo charger is mounted, a control of the exhaust gas is required. In addition, in the case of intending to calculate a mass of the exhaust gas, the temperature of the exhaust gas is required.

Therefore, the temperature of the exhaust gas, which is a main factor used to limit the performance of the engine or limit fuel injection depending on protection of the hardware of the engine, activation of the catalyst, and the like, may be an input variable necessary to control the engine.

Meanwhile, a pollutant of the exhaust gas exhausted from the engine is removed while the exhaust gas passes through a purifying device such as a catalyst converter, or the like. Then, the exhaust gas of which the pollutant is removed may be exhausted to the air.

A catalyst performing an oxidation-reduction reaction to the exhaust gas is embedded in the catalyst converter, and a temperature of the catalyst should be an activation temperature or more in order to activate the catalyst.

In addition, catalyst heating control for shortening a light-off temperature (LOT) arrival time of the catalyst is performed.

However, in a method for catalyst heating control according to the related art, the same control condition of a catalyst heating period is used regardless of an aging level of the catalyst. That is, since a fresh catalyst and an aging catalyst are used without being distinguished from each other, appropriate catalyst heating control depending on an aging level of the catalyst is not performed. Therefore, purifying efficiency of the exhaust gas depending on the aging level of the catalyst is decreased, and fuel efficiency is deteriorated.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a method for catalyst heating control configured for improving fuel efficiency by deciding an aging level of a catalyst through a temperature of exhaust gas determined using a lambda sensor and determining an appropriate time of a catalyst heating period depending on the aging level of the catalyst.

According to an exemplary embodiment of the present invention, a method for catalyst heating control for controlling a catalyst heating period of a catalyst heating system in which lambda sensors are each mounted at upstream and downstream sides of a catalyst converter includes: determining a temperature of exhaust gas; determining an oxygen storage capacity of a catalyst depending on the determined temperature of the exhaust gas; comparing the determined oxygen storage capacity with a reference value to decide an aging level of the catalyst; and determining times of the catalyst heating period to be different from each other depending on the decided aging level of the catalyst.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
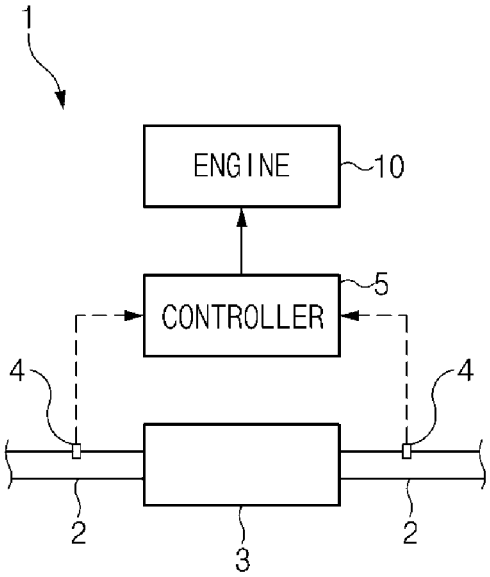
FIG. 1 is a view schematically illustrating a catalyst system according to the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, exemplary embodiments of the present invention will be described in detail with reference to the accompanying drawings. For reference, sizes of components, thicknesses of lines, and the like, illustrated in the accompanying drawings referred to in describing the present invention may be exaggerated for convenience of the understanding. In addition, since terms used in a description of the present invention are defined in consideration of functions of the present invention, they may be changed depending on the intension of users or operators, customs, and the like. Therefore, these terms should be defined based on entire contents of the present invention.

Referring to FIG. 1, a catalyst system 1 may include a catalyst converter 3 mounted in an exhaust route 2, and may include lambda sensors 4 each mounted at upstream and downstream sides of the catalyst converter 3.

An exhaust gas temperature sensor may be separately mounted in the exhaust route 2 to measure a temperature of exhaust gas on the catalyst system 1. However, the exhaust gas temperature sensor is configured to endure high-temperature exhaust gas, such that it is expensive. Therefore, a case in which the exhaust gas temperature sensor is not mounted realistically has been increased.

As described above, in the case in which the exhaust gas temperature sensor is not mounted, the temperature of the exhaust gas may be determined by modeling, and the determined temperature of the exhaust gas may be utilized to control an engine of a vehicle and control catalyst heating.

A process of determining the temperature of the exhaust gas by the modeling will be described in detail. In a development step of a vehicle, in a state in which the exhaust gas temperature sensor is actually mounted, data obtained by measuring the temperature of the exhaust gas depending on a revolution per minute (RPM) of an engine, a load, and the like, may be averaged to model a model value of the temperature of the exhaust gas depending on the RPM of the engine, the load, and the like. Then, in a mass production step of the vehicle, the data described above are input to an electronic control unit (ECU) of the vehicle. Therefore, the ECU of the vehicle may decide the model value of the temperature of the exhaust gas depending on the RPM of the engine, the load, and the like.

In the case in which the model value of the temperature of the exhaust gas described above is actually applied to the vehicle, it may not be appropriate for various conditions (for example, a condition in which the temperature of the exhaust gas may become high) of the engine due to a route of the exhaust gas, a tube condition, an error due to a heat transfer, and the like. Therefore, the model value of the temperature of the exhaust gas may be restrictively used in terms of safety for preventing damage to hardware of the engine and damage to the catalyst by securing a margin for the model value of the exhaust gas.

Therefore, in an exemplary embodiment of the present invention, the temperature of the exhaust gas may be determined using the lambda sensor 4 instead of the exhaust gas temperature sensor.

The lambda sensor 4, which is a gas sensor having output characteristics that an output signal of the sensor is significantly changed depending on whether or not target gas is present, may measure a lambda value. A heater is embedded in the lambda sensor 4, and a temperature of the lambda sensor 4 is changed depending on a change in the temperature of the exhaust gas, wherein a resistance value of the heater of the lambda sensor 4 may be changed.

A controller 5 monitoring the resistance value of the lambda sensor 4 may be connected to the lambda sensor 4.

According to an exemplary embodiment, the controller 5 may an ECU for a vehicle controlling an engine 10. In the case in which the controller 5 is the ECU for a vehicle as described above, the controller 5 performs a control to increase a fuel injection amount of the engine 10 for a predetermined time, wherein catalyst heating control allowing a temperature of the catalyst of the catalyst converter 3 to rapidly arrive at an activation temperature may be performed.

According to another exemplary embodiment, in the case in which a heater is embedded in the catalyst converter 3, the controller 5 may be configured to control the heater of the catalyst converter 3 to perform catalyst heating control, and may also be configured separately from the ECU for a vehicle.

The lambda sensor 4 should be activated within a predetermined activation time (A) to be normally operated. For example, the activation time (A) may be six seconds on the basis of a dew point.

The lambda sensor 4 may be heating-controlled on a basis of a temperature of approximately 800° C., and in the case in which a temperature of the lambda sensor 4 is 800° C., a resistance value of the lambda sensor 4 may be approximately 100 Ω. In the case in which the temperature of the exhaust gas is lower than 800° C., the resistance value of the lambda sensor 4 may be smaller than 100 Ω, and in the case in which the temperature of the exhaust gas is higher than 800° C., the resistance value of the lambda sensor 4 may be larger than 100 Ω. That is, the resistance value of the lambda sensor 4 may be changed in inverse proportion to the temperature of the exhaust gas.

The controller 5 may recognize a resistance value B of the lambda sensor 4, and recognize a temperature $T_s$ of the lambda sensor 4 through the resistance value B of the lambda sensor 4.

In addition, the controller 5 may determine a temperature $T_g$ of the exhaust gas from the temperature $T_s$ of the lambda sensor 4 through heat transfer relational expressions of the lambda sensor 4, or the like.

Meanwhile, the heat transfer relational expressions of the lambda sensor 4 may be the following Equation 1, Equation 2, Equation 3, and the like, by way of example.

$$\rho_s C_{ps} V_s \frac{dT_s}{dt} = -h_s A_s (T_s - T_g) + P - \frac{A_{sc} k_s}{L_s}(T_s - T_w) \quad \text{[Equation 1]}$$

Here, $P_s$ is a density (kg/m3) of the lambda sensor, $C_{ps}$ is a specific heat (J/kgK) of the lambda sensor, $V_s$ is a volume ($m^3$) of the lambda sensor, $T_s$ is a temperature (K) of the lambda sensor, $h_s$ is a heat transfer coefficient ($W/m^2K$) between the exhaust gas and the lambda sensor, $A_s$ is a heat transfer area ($m^2$) between the exhaust gas and the lambda sensor, $T_g$ is a temperature (K) of the exhaust gas, P is a power (W) input to the lambda sensor, $A_{sc}$ is a cross-sectional area ($m^2$) of the lambda sensor for heat conduction, $k_s$ is a heat conductivity (W/mK) of the lambda sensor, $L_s$ is a length (m) of the lambda sensor for heat conduction to an exhaust pipe, and $T_w$ is a temperature (K) of the exhaust pipe.

$$P = \eta VI \quad \text{[Equation 2]}$$

Here, P is a power (W) input to the lambda sensor, η is a duty cycle, and I is a current (A).

When Equation 2 is substituted into Equation 1, the following Equation 3 may be deduced.

$$T_g = T_s + \frac{\rho_s C_{ps} V_s \frac{dT_s}{dt} - P + \frac{A_{sc} k_s}{L_s}(T_s - T_w)}{h_s A_s} \quad \text{[Equation 3]}$$

Figure 2:
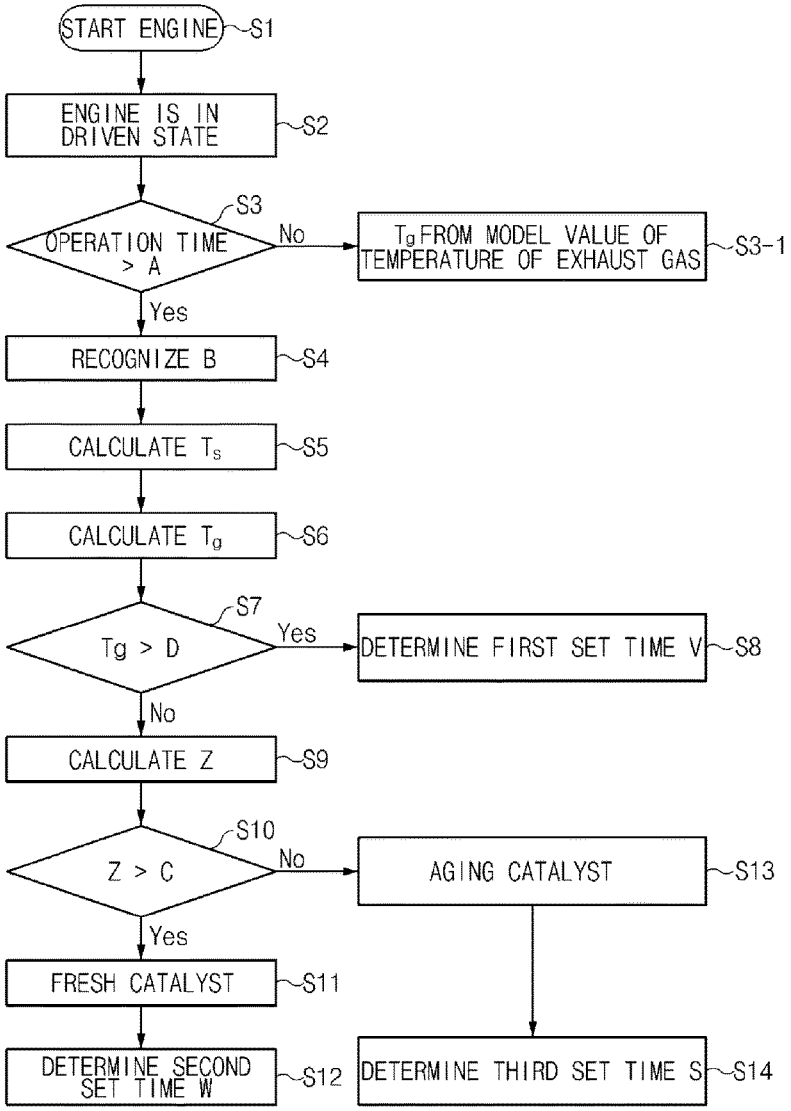
FIG. 2 is a flow chart illustrating a method for catalyst heating control according to various exemplary embodiments of the present invention.

FIG. 2 illustrates a method for catalyst heating control according to various exemplary embodiments of the present invention.

Referring to FIG. 2, after an engine starts (S1), the engine is in a driven state (S2).

Then, it is decided whether or not an operation time of the lambda sensor 4 is an activation time (A) or more, deciding whether the lambda sensor 4 is activated (S3).

When the operation time of the lambda sensor 4 is the activation time A or more, the controller 5 recognizes the resistance value B of the lambda sensor 4 (S4), and determines the temperature $T_s$ of the lambda sensor 4 through the resistance value B of the lambda sensor 4 (S5).

When the operation time of the lambda sensor 4 is less than the activation time A, the controller 5 may determine the temperature $T_g$ of the exhaust gas from the model value of the temperature of the exhaust gas modeled depending on the RPM of the engine, the load, and the like (S3-1).

Then, the controller 5 may determine the temperature $T_g$ of the exhaust gas from the temperature $T_s$ of the lambda sensor 4 through the heat transfer relational expressions of the lambda sensor 4, or the like (S6).

Then, it is decided whether or not the determined temperature $T_g$ of the exhaust gas is higher than a discrimination reference temperature D for discriminating an oxygen storage capacity (OSC) (S7). For example, the discrimination reference temperature D may be 650° C.

In the case in which the temperature $T_g$ of the exhaust gas is higher than the discrimination reference temperature D, a discrimination is not present between an oxygen storage capacity of a fresh catalyst and an oxygen storage capacity of an aging catalyst. The reason is that a distribution of the oxygen storage capacity of the fresh catalyst and a distribution of the oxygen storage capacity of the aging catalyst are overlapped with each other in many portions to show an irregular distribution tendency, in the case in which the temperature $T_g$ of the exhaust gas is higher than the discrimination reference temperature D.

Therefore, when it is decided that the temperature $T_g$ of the exhaust gas is higher than the discrimination reference temperature D, a time of a catalyst heating period is determined to be a first predetermined time V (S8).

Here, the first predetermined time V may be a time of a catalyst heating period for the aging catalyst to secure safety satisfying a regulation law of emission. For example, the first predetermined time V may be 50 seconds.

Then, when the temperature $T_g$ of the exhaust gas is lower than the discrimination reference temperature D, an oxygen storage capacity Z of the catalyst is determined depending on the temperature $T_g$ of the exhaust gas (S9).

The determined oxygen storage capacity Z is compared with at least one inflection value C, wherein it is decided whether or not the determined oxygen storage capacity Z is larger than the inflection values C (S10).

Here, the inflection value C indicates a value of an oxygen storage capacity corresponding to a rapid inflection point of the oxygen storage capacity Z changed depending on an aging level of a catalyst.

Figure 3:
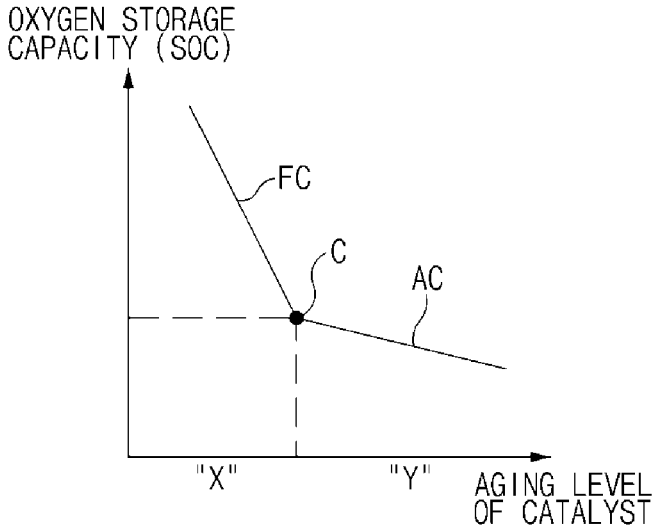
FIG. 3 is a graph illustrating an oxygen storage capacity (OSC) depending on an aging level of a catalyst.

For example, in the case in which the number of inflection values C is one as illustrated in FIG. 3 and the inflection value C is 1500 mmg, when the oxygen storage capacity Z is larger than the inflection value C, a catalyst may be decided to be a fresh catalyst, and when the oxygen storage capacity Z is smaller than the inflection value C, a catalyst may be decided to be an aging catalyst.

As illustrated in FIG. 3, it may be appreciated that a change tendency (see line FC of FIG. 3) of an oxygen storage capacity in a region X corresponding to the fresh catalyst and a change tendency (see line AC of FIG. 3) of an oxygen storage capacity in a region Y corresponding to the aging catalyst are different from each other.

Meanwhile, in FIG. 3, the change tendency (see line FC of FIG. 3) of the oxygen storage capacity in the region X corresponding to the fresh catalyst is briefly illustrated in a linear form by line FC, and the change tendency (see line AC of FIG. 3) of the oxygen storage capacity in the region Y corresponding to the aging catalyst is briefly illustrated in a linear form by line AC. However, the change tendencies of the oxygen storage capacities may also appear in various forms in addition to a simple linear form.

When it is decided that the oxygen storage capacity Z is larger than the inflection value C, the controller 5 decides that the catalyst of the catalyst converter 3 is the fresh catalyst (S11). Therefore, the controller 5 is configured to determine that a time of a catalyst heating period is a second predetermined time W (S12).

Here, since an oxygen storage capacity of the fresh catalyst is high, a time required for a temperature of the fresh catalyst to arrive at an activation temperature may be relatively short. Therefore, the second predetermined time W may be set to be relatively shorter than the first predetermined time V. For example, the second predetermined time W may be 20 seconds.

When it is decided that the oxygen storage capacity Z is smaller than the inflection value C, the controller 5 decides that the catalyst of the catalyst converter 3 is the aging catalyst (S13). Therefore, the controller 5 is configured to determine that a time of a catalyst heating period is a third predetermined time S (S14).

Here, since an oxygen storage capacity of the aging catalyst is low, a time required for a temperature of the aging catalyst to arrive at an activation temperature may be relatively long. Therefore, the third predetermined time S may be set to be relatively longer than the second predetermined time W. For example, the third predetermined time S may be 50 seconds. In addition, the third predetermined time S may also be set to be a same as the first predetermined time V.

Meanwhile, although a case in which one inflection value C appears has been illustrated in FIG. 3, at least two inflection values may appear depending on a specification of a catalyst. Therefore, an oxygen storage capacity may be compared with the respective inflection values to divide an aging level of the catalyst depending on cumulative mileage, making it possible to variously set the time of the catalyst heating period depending on the aging level of the catalyst.

As described above, according to the exemplary embodiment of the present invention, the aging level of the catalyst is decided through the temperature of the exhaust gas determined using the lambda sensor, and an appropriate catalyst heating period is determined depending on the aging level of the catalyst, making it possible to improve fuel efficiency.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method for catalyst heating control for controlling a catalyst heating period of a catalyst heating system in which sensors are each mounted at upstream and downstream sides of a catalyst converter, comprising:

determining, by an electronic control unit (ECU), a temperature of exhaust gas;

comparing, by the electronic control unit (ECU), the temperature of the exhaust gas with a discrimination reference temperature for discriminating the oxygen storage capacity;

determining, the electronic control unit (ECU), an oxygen storage capacity of a catalyst depending on the determined temperature of the exhaust gas;

comparing, by the electronic control unit (ECU) the determined oxygen storage capacity with a reference value to decide an aging level of the catalyst; and determining, by the electronic control unit (ECU) times of the catalyst heating period to be different from each other depending on the decided aging level of the catalyst, wherein when the temperature of the exhaust gas is higher than the discrimination reference temperature, a time of the catalyst heating period is determined to be a first predetermined time.

2. The method for catalyst heating control according to claim 1, wherein when the temperature of the exhaust gas is lower than the discrimination reference temperature, the oxygen storage capacity of the catalyst is determined, when the oxygen storage capacity is larger than an inflection value, the catalyst is decided to be a fresh catalyst, wherein a time of the catalyst heating period is determined to be a second predetermined time, and the inflection value is a value of an oxygen storage capacity corresponding to a rapid inflection point of the oxygen storage capacity changed depending on the aging level of the catalyst.

3. The method for catalyst heating control according to claim 2, wherein the second predetermined time is shorter than the first predetermined time.

4. The method for catalyst heating control according to claim 3, wherein when the oxygen storage capacity is smaller than the inflection value, the catalyst is decided to be an aging catalyst, wherein a time of the catalyst heating period is determined to be a third predetermined time.

5. The method for catalyst heating control according to claim 4, wherein the third predetermined time is longer than the second predetermined time.

6. The method for catalyst heating control according to claim 1, wherein after an engine starts, the temperature of the exhaust gas is determined through a temperature of the sensors.

7. The method for catalyst heating control according to claim 6, wherein when an operation time of the sensors is an activation time or more, a resistance value of the sensors is recognized, and the temperature of the sensors is determined through the resistance value of the sensors.

8. The method for catalyst heating control according to claim 7, wherein the temperature of the exhaust gas is determined from the temperature of the sensors through heat transfer relational expressions of the sensors.

9. The method for catalyst heating control according to claim 8, wherein the sensors are lambda sensors.

* * * * *